US010589894B2

(12) United States Patent
Niedzwiecki

(10) Patent No.: US 10,589,894 B2
(45) Date of Patent: Mar. 17, 2020

(54) CORRUGATED BOX WITH HAND OPENINGS IN THE FRONT

(71) Applicant: Hill's Pet Nutrition, Inc., Topeka, KS (US)

(72) Inventor: Jason Niedzwiecki, Shawnee, KS (US)

(73) Assignee: Colgate-Palmolive Company, New York, NY (US)

( * ) Notice: Subject to any disclaimer, the term of this patent is extended or adjusted under 35 U.S.C. 154(b) by 16 days.

(21) Appl. No.: 15/677,779

(22) Filed: Aug. 15, 2017

(65) Prior Publication Data

US 2019/0055049 A1 Feb. 21, 2019

(51) Int. Cl.

| | |
|---|---|
| ***B65D 5/468*** | (2006.01) |
| ***B65D 5/10*** | (2006.01) |
| ***B65D 5/42*** | (2006.01) |

(52) U.S. Cl.

CPC ..... *B65D 5/4608* (2013.01); *B65D 5/10* (2013.01); *B65D 5/4266* (2013.01)

(58) Field of Classification Search

CPC ..... B65D 5/4608; B65D 5/10; B65D 5/4266; B65D 71/36; B65D 2571/0045

USPC ..... 229/117.13, 117.14, 117.16, 174, 103.2, 229/117.12

See application file for complete search history.

(56) References Cited

U.S. PATENT DOCUMENTS

| | | | | |
|---|---|---|---|---|
| 2,296,389 | A | 9/1942 | Levkoff | |
| 3,659,774 | A * | 5/1972 | Mielke | B65D 5/445 220/642 |
| 4,787,515 | A * | 11/1988 | Stoll | B65D 5/0055 206/509 |
| 6,619,540 | B1 * | 9/2003 | Bazany | B65D 5/0055 220/642 |
| 9,180,996 | B2 | 11/2015 | Mathieu | |
| 9,636,882 | B2 * | 5/2017 | Holley, Jr. | B65D 71/36 |
| 9,770,880 | B2 * | 9/2017 | Schuster | B31B 50/26 |

OTHER PUBLICATIONS

"How to assemble a bankers box", Yahoo Internet search, Retrieved from the internet on Aug. 3, 2017: https://images.search.yahoo.com/search/images;_ylt=A0SO81VsUoNZB9wAZxdXNyoA;_ylu=X3oDMTB0NjZjZzZhBGNvbG8DZ3ExBHBvcwMxBHZ0aWQDBHNIYwNwaXZz?p=how+to+assemble+a+bankers+box&fr2=piv-web&fr=yfp-t, pp. 1-4.

* cited by examiner

*Primary Examiner* — Christopher R Demeree

(57) ABSTRACT

A box includes a major flap and a minor flap. The major flap is configured to pivot between an open position and a closed position around a first hinge. The major flap includes a major flap opening. The minor flap is configured to pivot between an open position and a closed position around a second hinge. The minor flap includes a minor flap opening. The major flap opening and the minor flap opening are at least partially aligned with one another when the major flap and the minor flap are in the closed positions.

10 Claims, 6 Drawing Sheets

CORRUGATED BOX WITH HAND OPENINGS IN THE FRONT

BACKGROUND

Corrugated fiberboard boxes are used for storing and carrying items. Some conventional corrugated fiberboard boxes include handles in the form of openings in opposing side walls for receiving a person's hands. The side walls oftentimes each include a single panel of corrugated fiberboard, which limits the amount of weight that the box can support while a person is holding the box by the openings before the single-panel side walls rip or tear from the weight. Sometimes, the side walls each include two panels (i.e., double-layered side walls), which may increase the amount of weight that the box handles can support. However, when the panels in such a conventional box are corrugated, the orientation or direction of the corrugations of the panels is the same (i.e., aligned) for each panel, which can induce tearing along the corrugation direction when the amount of weight is increased. It would therefore be desirable to have a box with improved structural integrity.

BRIEF SUMMARY

A box includes a major flap and a minor flap. The major flap is configured to pivot between an open position and a closed position around a first hinge. The major flap includes a major flap opening. The minor flap is configured to pivot between an open position and a closed position around a second hinge. The minor flap includes a minor flap opening. The major flap opening and the minor flap opening are at least partially aligned with one another when the major flap and the minor flap are in the closed positions.

In another embodiment, the box includes a first major top flap configured to pivot between an open position and a closed position around a first hinge. The first major top flap includes a first major top flap opening. The box also includes a second major top flap configured to pivot between an open position and a closed position around a second hinge. The second major top flap includes a second major top flap opening. The first and second major top flaps includes first corrugations that are oriented in a first direction. The box also includes a minor top flap configured to pivot between an open position and a closed position around a third hinge. The minor top flap includes a first minor top flap opening and a second minor top flap opening. The first major top flap opening and the first minor top flap opening are at least partially aligned with one another and the second major top flap opening and the second minor top flap opening are at least partially aligned with one another when the first major top flap, the second major top flap, and the minor top flap are in the closed positions. The minor top flap includes second corrugations that are oriented in a second direction that is substantially perpendicular to the first direction when the first major top flap, the second major top flap, and the minor top flap are in the closed positions.

A corrugated fiberboard blank for producing the box is also disclosed. The blank includes a minor top flap including a first minor top flap opening and a second minor top flap opening. The blank also includes a width panel coupled to the minor top flap. An intersection between the minor top flap and the width panel is scored. The blank also includes a first length panel coupled to the width panel. An intersection between the first length panel and the width panel is scored. The blank also includes a first major top flap coupled to the first length panel. The first major top flap comprises a first major top flap opening. An intersection between the first major top flap and the first length panel is scored. The blank also includes a second length panel coupled to the width panel. An intersection between the second length panel and the width panel is scored. The blank also includes a second major top flap coupled to the second length panel. The second major top flap comprises a second major top flap opening. An intersection between the second major top flap and the second length panel is scored. The minor top flap is positioned between the first major top panel and the second major top panel.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawing, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

The box disclosed herein includes improved openings/handholes for lifting the box when a heavy product is located therein. The openings may be placed on the major and minor flaps and provide improved gripping during handling and a high resistance to tearing or failure. The openings may be located to distribute the load substantially evenly. The openings in the major and minor flaps may be aligned when the box is in its final/folded construction. In the final/folded construction, corrugations in the major and minor flaps may be substantially perpendicular to one another. This creates a durable opening/handhole that is resistant to tearing or failing during handling.

Figure 1:
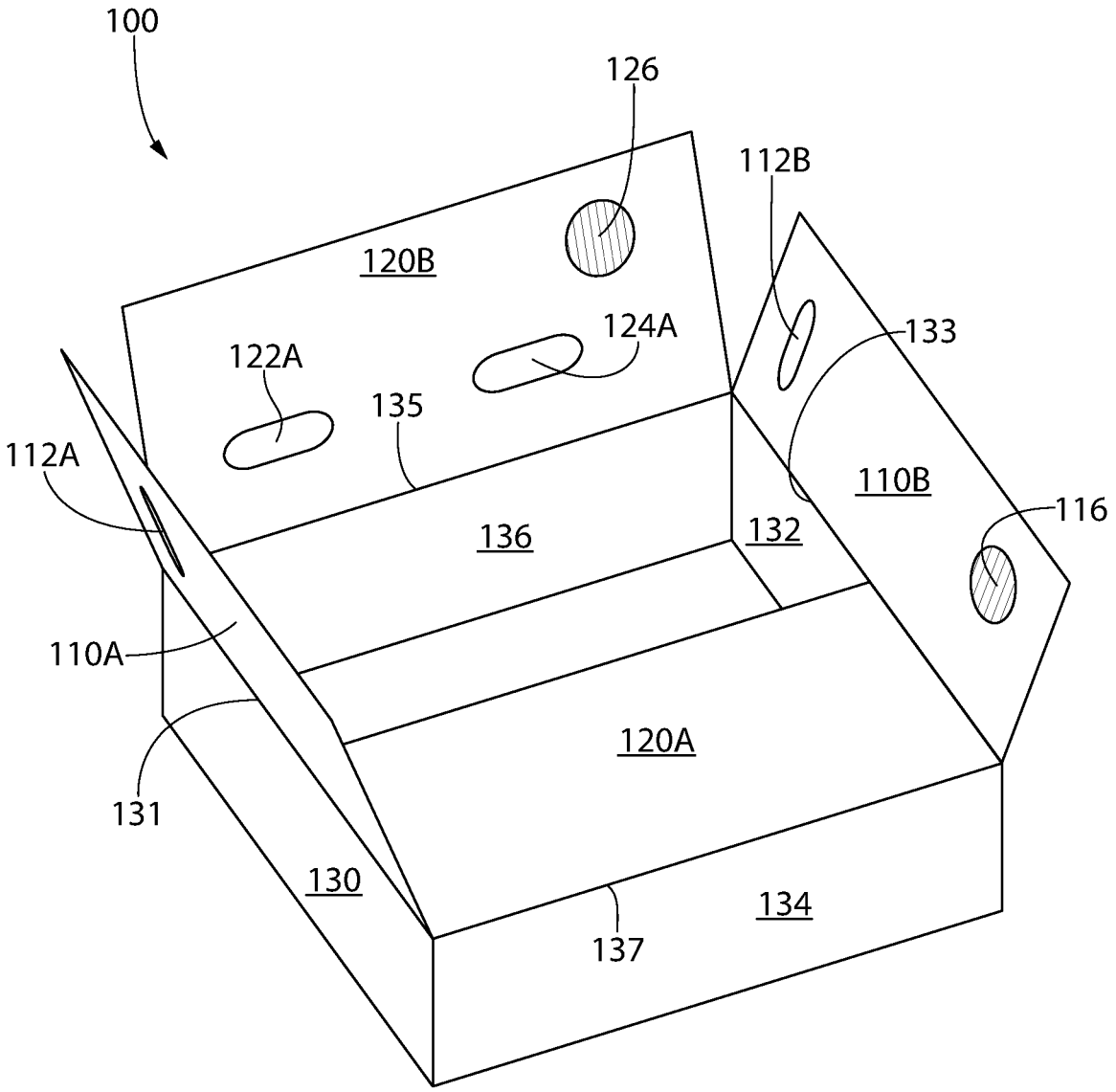
FIG. 1 depicts a perspective view of an example of a box in a partially open state, according to an embodiment.

FIG. 1 depicts a perspective view of an example of a box 100 in a partially open state, according to an embodiment. The box 100 may include a first major top flap 110A, a second major top flap 110B, a first minor top flap 120A, and a second minor top flap 120B. The box 100 may also include four side walls/panels: a first length panel 130, a second length panel 132, a first width panel 134, and a second width panel 136.

The first major top flap 110A may be coupled to or integral with the first length panel 130 and configured to pivot between an open position (as shown) and a closed position around a hinge 131 (e.g., a fold) with respect to the first length panel 130. The second major top flap 110B may be coupled to or integral with the second length panel 132 and configured to pivot between an open position (as shown) and a closed position around a hinge 133 (e.g., a fold) with respect to the second length panel 132. The first minor top flap 120A may be coupled to or integral with the first width panel 134 and configured to pivot between an open position (as shown) and a closed position around a hinge 135 (e.g., a fold) with respect to the first width panel 134. The second minor top flap 120B may be coupled to or integral with the second width panel 136 and configured to pivot between an open position and a closed position (as shown) around a hinge 137 (e.g., a fold) with respect to the second width panel 136. The hinges 131, 133 may be oriented at an angle from about 0° to about 180°, about 45° to about 135°, or about 90° with respect to the hinges 135, 137. In at least one embodiment, the flaps 110A, 110B, 120A, 120B may be attached along one side/edge (e.g., hinges 131, 133, 135, 137) and free along the other sides/edges.

When the flaps 110A, 110B, 120A, 120B are in the open positions, the box 100 is in an open state. When the flaps 110A, 110B, 120A, 120B are in the closed positions, the box 100 is in a closed state. As shown in FIG. 1, when one or more of the flaps (e.g., 110A, 110B, 120A) is/are in the open position(s), and one or more of the flaps (e.g., 120B) is/are in the closed position(s), the box 100 is referred to as being in a partially open state. The minor top flaps 120A, 120B may be pivoted into the closed position before the major top flaps 110A, 110B. As a result, each of the major top flaps 110A, 110B may be positioned outside of and at least partially overlap each of the minor top flaps 120A, 120B when the box 100 is in the closed state.

The box 100 may be made of corrugated fiberboard, plastic corrugated, solid fiberboard, or a combination thereof. In one embodiment, the box 100 may be made of a corrugated fiberboard. As shown in the cutaway portion included in FIG. 1 for clarity of illustration, the first major top flap 110A and the second major top flap 110B may have corrugations 116 that are oriented in a first direction (e.g., when the box 100 is in the closed state). As shown in the other cutaway portion included in FIG. 1 for clarity of illustration, the first minor top flap 120A and the second minor top flap 120B may have corrugations 126 that are oriented in a second direction (e.g., when the box 100 is in the closed state). The first and second directions may be substantially perpendicular to one another when the box 100 is in the closed state.

The first major top flap 110A may have one or more openings/handholes (one is shown: 112A) formed therethrough. The second major top flap 110B may also have one or more openings/handholes (one is shown: 112B) formed therethrough. The second minor top flap 120B may have one or more openings/handholes (two are shown: 122A, 124A) formed therethrough. As described in greater detail below (and shown in FIG. 2), when the box 100 is in the closed state, the opening 112A in the first major top flap 110A may be aligned (i.e., overlap) with the opening 122A in the second minor top flap 120B, and the opening 112B in the second major top flap 110B may be aligned (i.e., overlap) with the opening 124A in the second minor top flap 120B.

Figure 2:
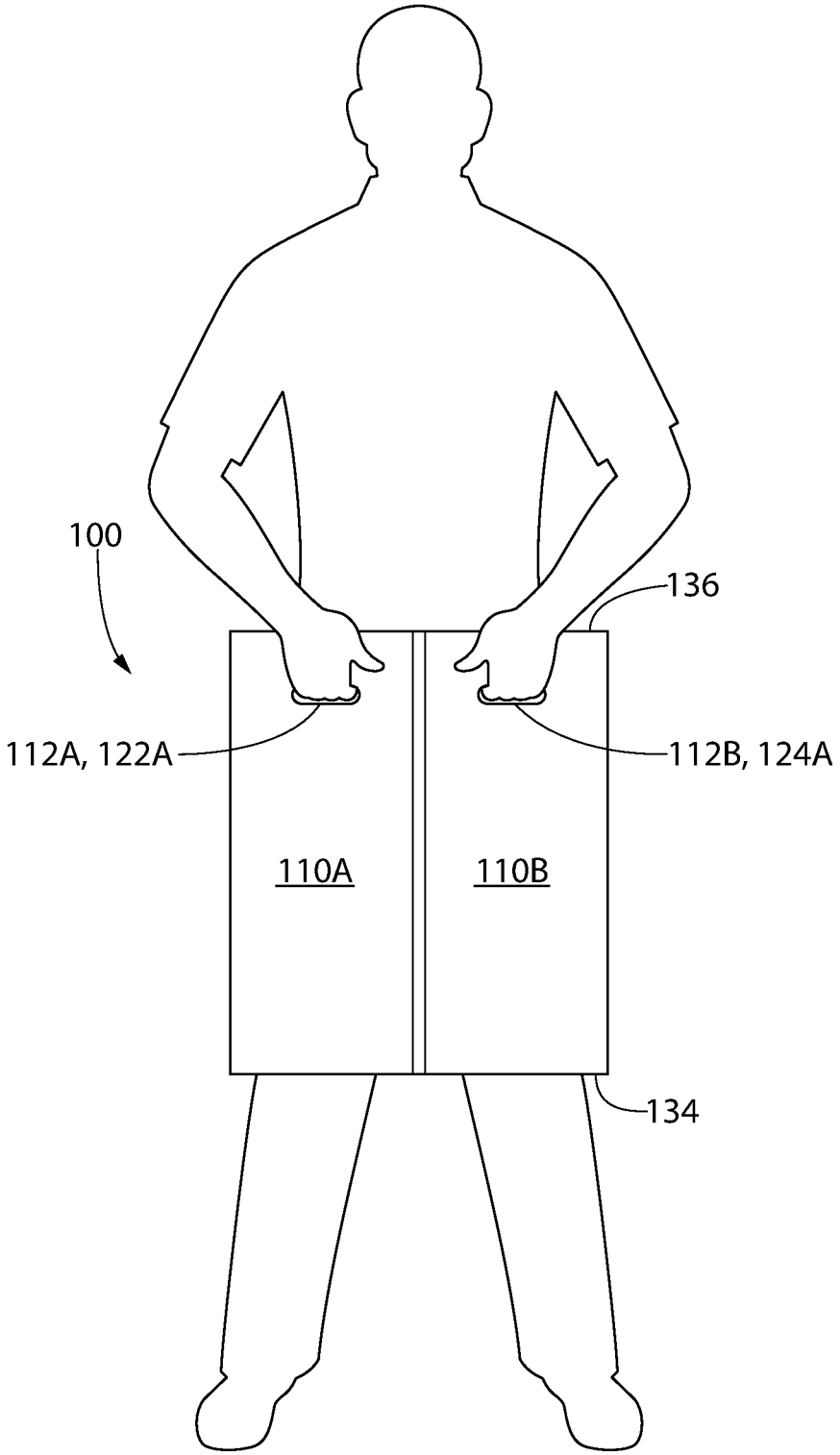
FIG. 2 depicts a perspective view of an example of the box in a closed state and upright position, according to an embodiment.

FIG. 2 depicts a perspective view of an example of the box 100 in the closed state, according to an embodiment. The box 100 is also shown in an upright position in FIG. 2. In the upright position, the first width panel 134 faces downward, and the second width panel 136 faces upward. To pick up the box 100 in the closed state and upright position, a person may insert one hand through the aligned openings 112A, 122A and another hand through the aligned openings 112B, 124A and lift. As shown, when a person is carrying the box 100 in the closed state and the upright position, the first and second major top flaps 110A, 110B and the first and second minor top flaps 120A, 120B may together form a (e.g., front) wall of the box 100 that faces away from the person. The box 100 may be used to store and carry object(s). In at least one embodiment, the object(s) in the box 100 may be or include pet food.

Having the weight of the box 100 and the object(s) positioned therein supported by multiple (e.g., two) layers of overlapping flaps 110A, 120A and 110B, 120A that form the front wall increases the structural integrity of the box 100 when compared to a conventional box with openings through a single flap/wall due to the multiple layers. In addition, having the corrugations 116, 126 of the overlapping flaps 110A, 120A and 110B, 120A be substantially perpendicular to one another further increases the structural integrity of the box 100 due to flaps' increased resistance to ripping or tearing across or perpendicular to the direction of the corrugations of at least one (e.g., two) of the overlapping flaps 110A, 120A and 110B, 120A. For example, a corrugated fiberboard box with this design, having a 35 lb. sack of pet food positioned therein, was able to be carried up and down multiple flights of stairs without any structural failures (e.g., tearing, ripping) occurring to the box.

Figure 3:
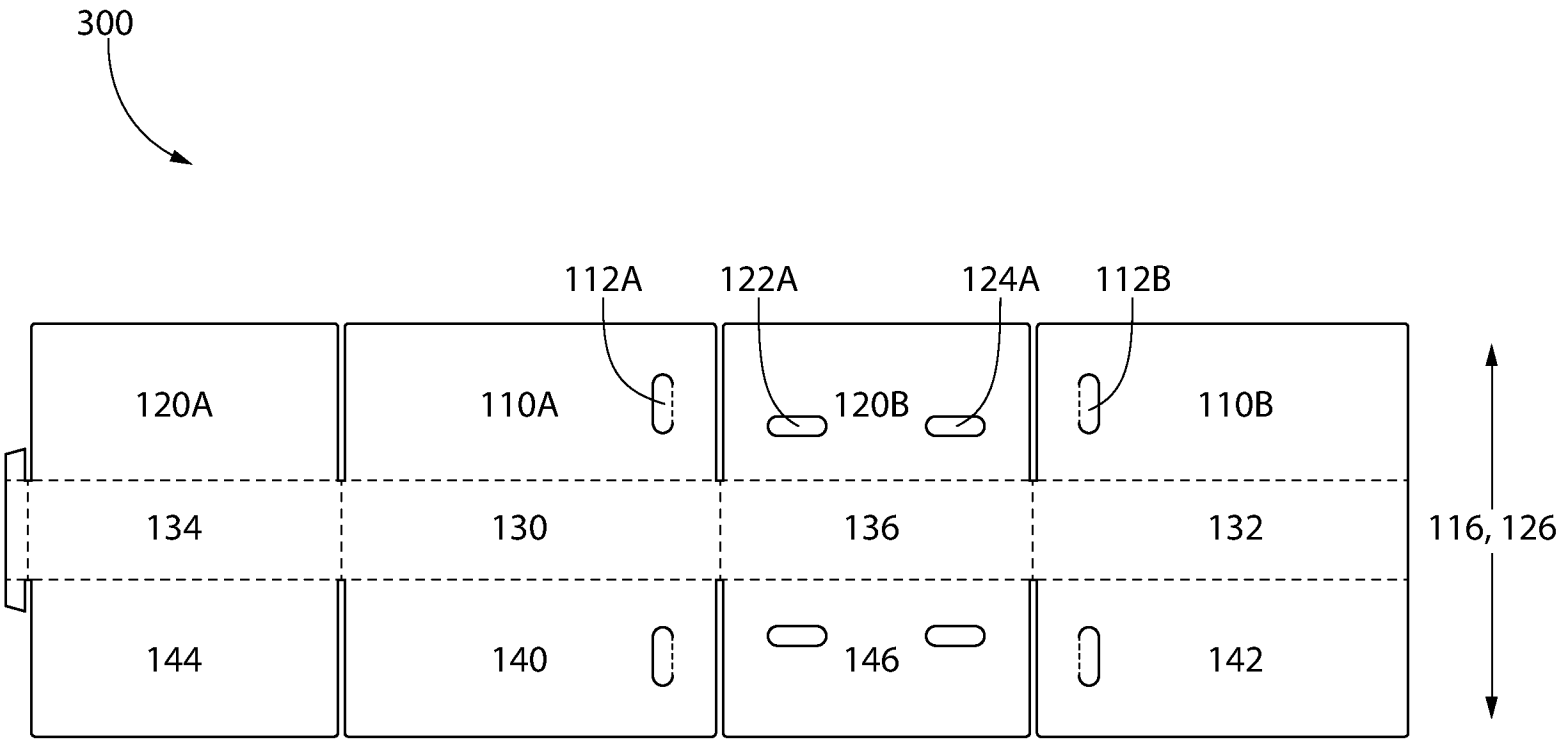
FIG. 3 depicts a top view of an example of a blank that may be cut, scored, and/or folded to produce the box, according to an embodiment.

FIG. 3 depicts a top view of an example of a blank 300 that may be cut, scored, and/or folded to produce a box, such as the box 100, according to an embodiment. The blank 300 may be cut and scored to produce a plurality of flaps and walls/panels. The solid lines represent cuts, and the dashed lines represent scores. In various embodiments, the scores may be produced by compressing or flattening the material (e.g., corrugated fiberboard) of the blank 300 to produce a line or linear area that is amenable to folding.

As shown, after cutting and scoring, the blank 300 may include:

The first major top flap 110A;
The second major top flap 110B;
The first minor top flap 120A;
The second minor top flap 120B;
The first length panel 130;
The second length panel 132;
The first width panel 134;
The second width panel 136;
The first major bottom flap 140;
The second major bottom flap 142;
The first minor bottom flap 144;
The second minor bottom flap 146;
The first major top flap opening 112A (e.g., with scored hinge);

The second major top flap opening 112B (e.g., with scored hinge);

The first minor top flap opening 122A (e.g., with full cutout); and

The second minor top flap opening 124A (e.g., with full cutout).

The corrugations 116, 126 of blank 300 may all be in a single direction (i.e., parallel) before the blank 300 is folded to form the box 100, as the folding will perpendicularly orient or align the corrugations of the flaps and of the inner walls as described previously.

Figure 4:
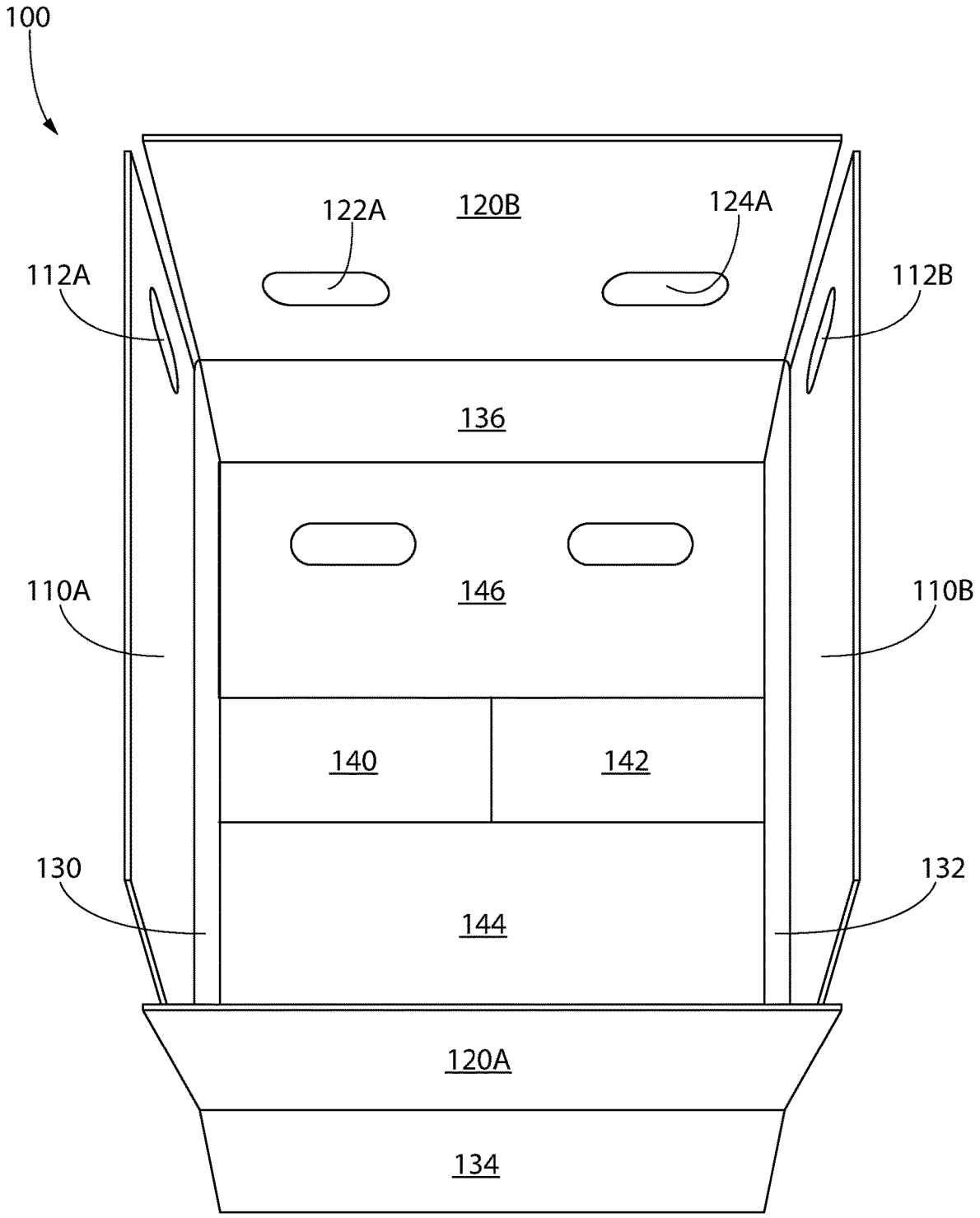
FIG. 4 depicts a top view of the blank after it is cut, scored, and/or folded to produce the box, according to an embodiment.

FIG. 4 depicts a top view of the box 100 after the blank 300 is cut, scored, and folded, according to an embodiment. As shown, the first major bottom flap 140, the second major bottom flap 142, the first minor bottom flap 144, and the second minor bottom flap 146 may together form a (e.g., back/rear) wall of the box 100. The back/rear wall of the box 100 may face toward the person when the box 100 is being carried. In some embodiments (not shown) the back/rear wall of the box 100 may not have openings.

Figure 5:
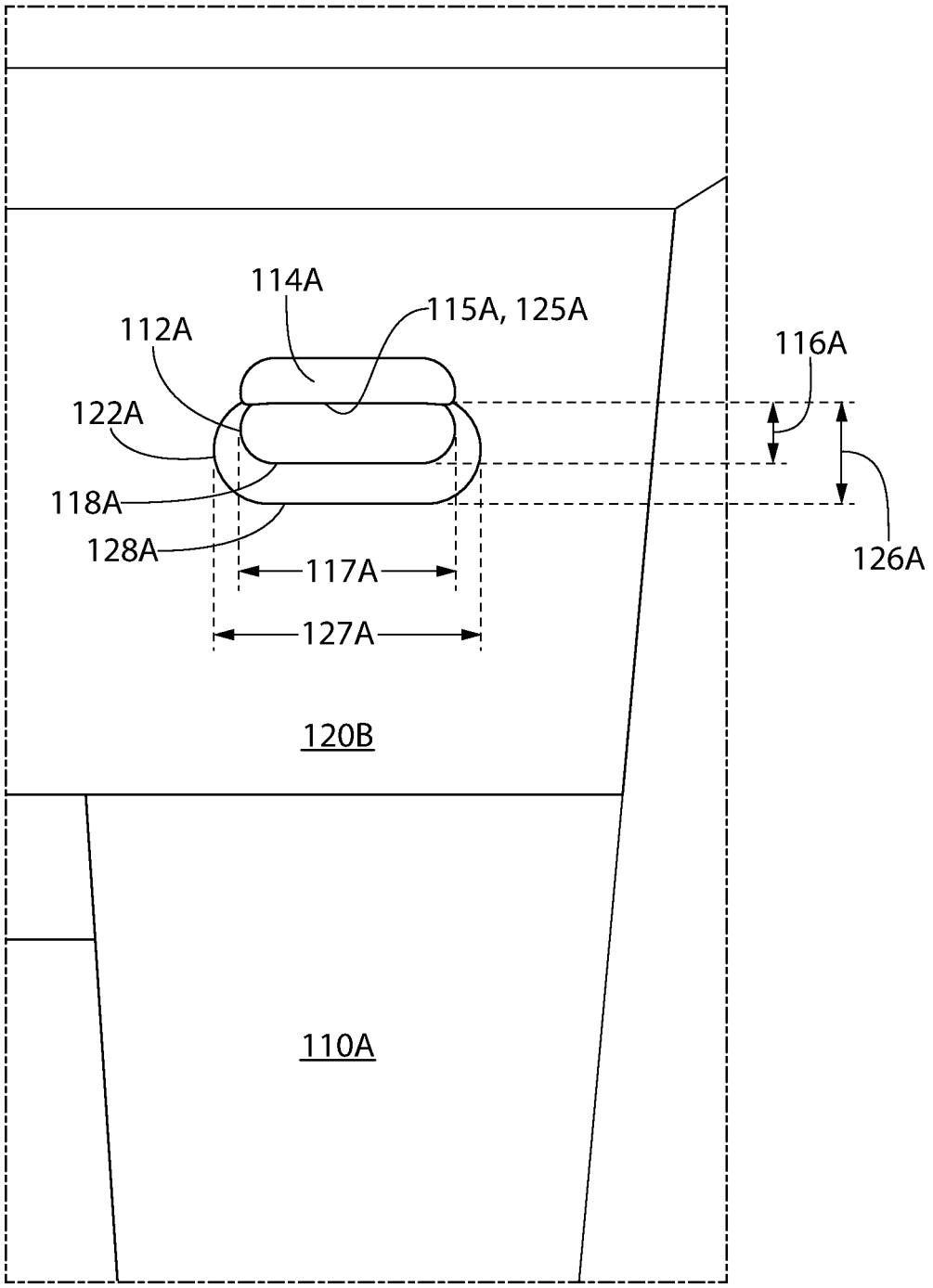
FIG. 5 depicts a view from inside the box looking at an interior of a first major flap and an interior of a first minor flap and showing a partial cutout from the first major flap folded through an opening in the first minor flap, according to an embodiment.
Figure 6:
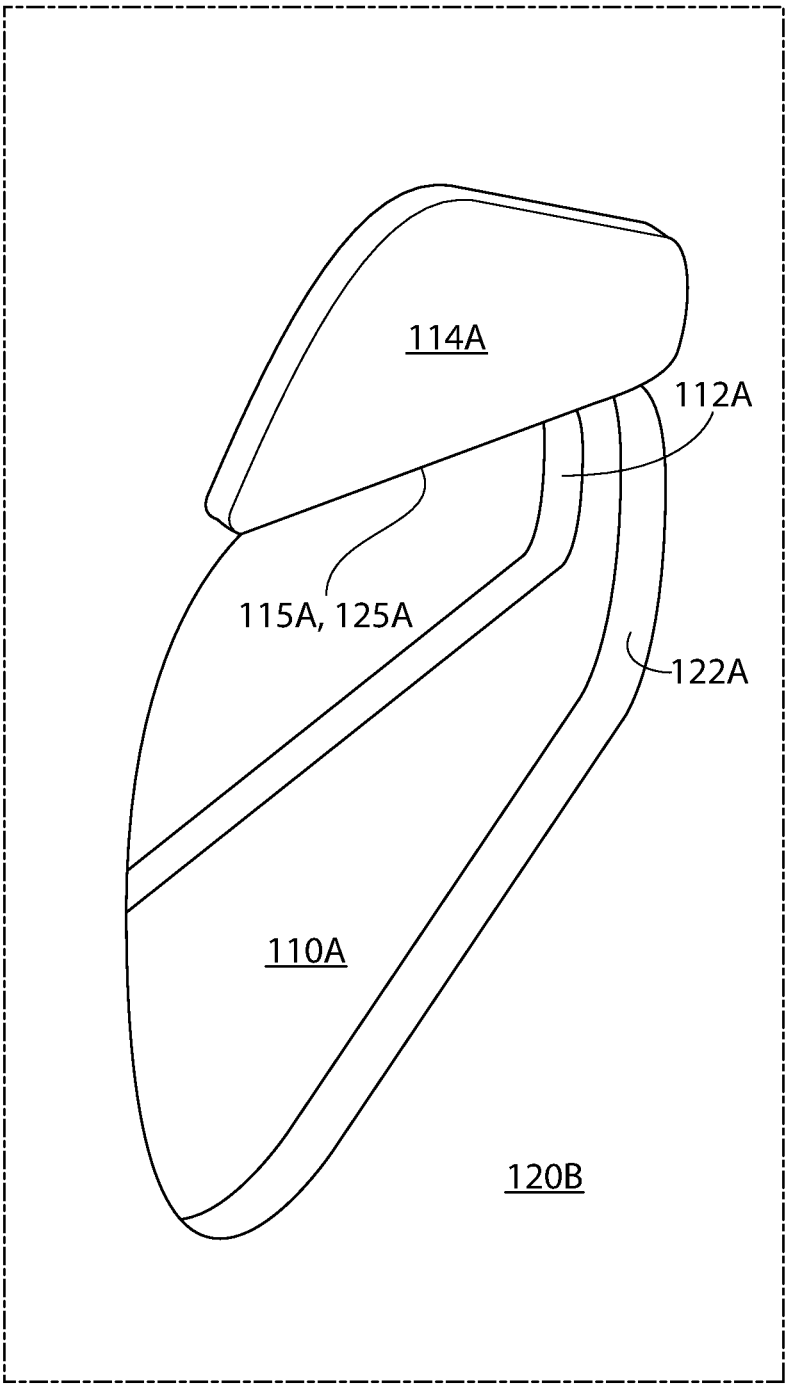
FIG. 6 depicts another view from inside the box looking at the interior of the first major flap and the interior of the first minor flap and showing the partial cutout from the first major flap folded through the opening in the first minor flap, according to an embodiment.

FIGS. 5 and 6 depict views from inside the box 100 looking at an interior of the first major flap 110A and the interior of the first minor top flap 120A, according to an embodiment. FIGS. 5 and 6 show a partial cutout 114A from the first major top flap 110A folded through the opening 122A in the second minor top flap 120B, according to an embodiment. The partial cutout 114A in the first major top flap 110A may be perforated or cut away from the first major top flap 110A around a first portion of the perimeter of the partial cutout 114A. As shown, the first portion of the perimeter of the partial cutout 114A includes opposing side edges and a bottom edge of the partial cutout 114A. However, the partial cutout 114A may not be completely cut away from the first major top flap 110A, and instead be scored around a second portion of the perimeter of the partial cutout 114A to form a hinge 115A around which the partial cutout 114A may pivot. As shown, the second portion of the perimeter (i.e., the hinge 115A) may include a top edge of the partial cutout 114A. The partial cutout 114A is not shown in the embodiment of FIG. 1.

Thus, when the partial cutout 114A is pressed/pushed inward, the partial cutout 114A may tear away along the first portion of the perimeter and pivot around the hinge 115A. When the opening 112A in the first major top flap 110A (created when the partial cutout 114A is pushed/pressed) is aligned (e.g., overlapping) with the opening 122A in the second minor top flap 120B, as shown in FIGS. 5 and 6, the partial cutout 114A may be folded into/through the opening 122A. The partial cutout 114A may then be folded upward (e.g., toward the first width panel 134) such that the partial cutout 114A at least partially overlaps with the first minor top flap 120A. Thus, a portion of the first minor top flap 120A may be positioned between the first major top flap 110A and the partial cutout 114A. This may interlock the first major top flap 110A and the first minor top flap 120A together. A similar configuration may be used to interlock the second major top flap 110B and the first minor top flap 120A together.

The opening 112A in the first major top flap 110A may have a lesser height 116A and/or width 117A than a height 126A and/or width 127A than the opening 122A in the second minor top flap 120B. This may facilitate the partial cutout 114A being folded into/through the opening 122A in the second minor top flap 120B even if the openings 112A, 122A are not perfectly aligned. In addition, upper edge (e.g., the hinge 115A) of the opening 112A in the first major top flap 110A may be closer to an upper edge 125A of the opening 122A in the second minor top flap 120B than a lower edge 118A of the opening 112A in the first major top flap 110A is to a lower edge 128A of the opening 122A in the second minor top flap 120B. For example, the upper edge (e.g., the hinge 115A) of the opening 112A in the first major top flap 110A may be substantially aligned with the upper edge 125A of the opening 122A in the second minor top flap 120B. This may facilitate spreading the weight of the box 100 and any object(s) therein evenly between the flaps 110A, 120A and 110B, 120A when the box 100 is being carried.

What is claimed is:

1. A corrugated fiberboard box, comprising:

a first major top flap configured to pivot between an open position and a closed position around a first hinge, wherein the first major top flap comprises a first major top flap opening;

a second major top flap configured to pivot between an open position and a closed position around a second hinge, wherein the second major top flap comprises a second major top flap opening, and wherein the first and second major top flaps comprise first corrugations that are oriented in a first direction; and a minor top flap configured to pivot between an open position and a closed position around a third hinge, wherein:

the minor top flap comprises a first minor top flap opening and a second minor top flap opening, the first major top flap opening and the first minor top flap opening are at least partially aligned with one another and the second major top flap opening and the second minor top flap opening are at least partially aligned with one another when the first major top flap, the second major top flap, and the minor top flap are in the closed positions, and the minor top flap comprises second corrugations that are oriented in a second direction when the first major top flap, the second major top flap, and the minor top flap are in the closed positions.

2. The corrugated fiberboard box of claim 1, wherein the third hinge is substantially perpendicular to the first hinge and the second hinge, and wherein the first major top flap comprises a partial cutout that pivots around a fourth hinge to create the first major top flap opening.

3. The corrugated fiberboard box of claim 2, wherein the partial cutout is configured to be folded through the first minor top flap opening such that the partial cutout at least partially overlaps with the minor top flap to interlock the first major top flap and the minor top flap when the first major top flap and the minor top flap are in the closed positions.

4. The corrugated fiberboard box of claim 3, wherein a height and a width of the first minor top flap opening are greater than a corresponding height and a corresponding width of the first major top flap opening.

5. The corrugated fiberboard box of claim 4, wherein an upper edge of the first major top flap opening is closer to an upper edge of the first minor top flap opening than a lower edge of the first major top flap opening is to a lower edge of the first minor top flap opening.

6. The corrugated fiberboard box of claim 5, wherein the upper edge of the first major top flap opening is substantially aligned with the upper edge of the first minor top flap opening.

7. A corrugated fiberboard blank for producing a box, comprising:

a minor top flap comprising a first minor top flap opening and a second minor top flap opening;

a width panel coupled to the minor top flap, wherein an intersection between the minor top flap and the width panel is scored;

a first length panel coupled to the width panel, wherein an intersection between the first length panel and the width panel is scored;

a first major top flap coupled to the first length panel, wherein the first major top flap comprises a first major top flap opening, wherein an intersection between the first major top flap and the first length panel is scored;

a second length panel coupled to the width panel, wherein an intersection between the second length panel and the width panel is scored; and a second major top flap coupled to the second length panel, wherein the second major top flap comprises a second major top flap opening, wherein an intersection between the second major top flap and the second length panel is scored, and wherein the minor top flap is positioned between the first major top flap and the second major top flap.

8. The corrugated fiberboard blank of claim 7, wherein the first major top flap comprises a partial cutout that is configured to move around a scored hinge to form the first major top flap opening.

9. The corrugated fiberboard blank of claim 8, wherein a gap is present between the minor top flap and the first major top flap.

10. The corrugated fiberboard blank of claim 9, wherein the minor top flap comprises first corrugations, wherein the first major top flap comprises second corrugations, and wherein the first corrugations and the second corrugations are parallel to one another.

* * * * *